US005752606A

United States Patent [19]

Wilson et al.

[11] Patent Number: 5,752,606

[45] Date of Patent: May 19, 1998

[54] METHOD FOR TRAPPING, MANIPULATING, AND SEPARATING CELLS AND CELLULAR COMPONENTS UTILIZING A PARTICLE TRAP

[76] Inventors: Steve D. Wilson, P.O. Box 415, Soquel, Calif. 95073; William L. Clarke, 2221 Aralia St., Newport, Calif. 92660

[21] Appl. No.: 671,127

[22] Filed: May 23, 1996

[51] Int. Cl.[6] ..... B07C 5/02

[52] U.S. Cl. ..... 209/2; 209/3.1; 209/606

[58] Field of Search ..... 209/2, 3.1, 3.3, 209/579, 606, 127.2, 4, 8, 11; 250/251

[56] References Cited

U.S. PATENT DOCUMENTS

| | | | |
|---|---|---|---|
| 3,710,279 | 1/1973 | Ashkin | 250/251 X |
| 3,778,612 | 12/1973 | Ashkin | 250/251 |
| 3,808,550 | 4/1974 | Ashkin | 250/251 X |
| 4,025,787 | 5/1977 | Janner et al. | 250/251 |
| 4,115,078 | 9/1978 | Janner et al. | 250/251 X |
| 4,327,288 | 4/1982 | Ashkin et al. | 250/251 |
| 4,366,379 | 12/1982 | Cotter | 250/251 |
| 4,887,721 | 12/1989 | Martin et al. | 209/579 |
| 4,893,886 | 1/1990 | Ashkin et al. . | |
| 5,170,890 | 12/1992 | Wilson et al. | 209/3.1 |

FOREIGN PATENT DOCUMENTS

| | | | |
|---|---|---|---|
| 0988378 | 1/1983 | U.S.S.R. | 209/579 |

*Primary Examiner*—David H. Bollinger
*Attorney, Agent, or Firm*—Jeffrey A. Hall

[57] ABSTRACT

A method for trapping, separating, manipulating and controlling particles and molecules of biological origin is disclosed. The method comprises containing the particles or molecules of biological origin in a vacuum, projecting a beam of light onto the particles, inducing the beam of light to impart a spinning motion to the particles, inducing the beam of light to impart a dipole moment to the particles, generating a field density gradient in the vacuum, trapping the particles in the team of light, concentrating the particles at a focal plane of the beam, and, then manipulating the particles by a second beam of light. Particles are caused to spin and interact with the energy gradient of the beam of light, causing them to orbit in a controlled manner. The particles and molecules of biological origin include bacteria, viruses, cells, organelles, chromosomes, and the like.

19 Claims, 2 Drawing Sheets

METHOD FOR TRAPPING, MANIPULATING, AND SEPARATING CELLS AND CELLULAR COMPONENTS UTILIZING A PARTICLE TRAP

BACKGROUND OF THE INVENTION

1. Field of Invention

This invention relates generally to methods and apparatuses for guiding, trapping, concentrating, and separating particles and molecules of biological origin such as cells, bacteria, viruses, organelles, chromosomes, and the like. More particularly, the present invention relates to a method by which particles and molecules of biological origin are manipulated and controlled by beams of light so that the particles move in a controllable manner, resulting in a method for trapping, concentrating, separating, and controlling the movement of the particles and molecules of biological origin.

2. Description of Prior Art

The present invention is related to the method disclosed by the present inventors in U.S. Pat. No. 5,170,890 issued Dec. 15, 1992 where particles may be trapped in a focused light beam by a spin-gradient mechanism and then controlled and manipulated. The present invention also utilizes the exploitation of an anomalous interaction (force) between the gradient field density and a particle spin induced by an intense beam of light. Such interaction can dominate the visual light pressure and cause particles to be attracted to a beam focus against the direction of the propagating vector of the light. However, in the present disclosure a methodology for the trapping, manipulating, and control of particles and molecules of biological origin, such as cells, organelles, chromosomes, bacterial, viruses, and the like, is disclosed where multiple light beams are utilized to achieve such trapping, manipulation, and control of biological particles and molecules.

Such phenomena is observed at several different length and time scales in a number of different environments, i.e., micron-sized particles in cells, membranes or organelles, angstrom-sized particles in a vacuum, and the like. The control of the motion of such particles in such varying environments is a fundamental feature of this invention. For example, for a micron-sized particle in a partially evacuated chamber, a laser may be used to induce a rapid spinning motion of a particle. In such high Reynolds' number fluid dynamical regime, the particle induces a turbulent vortex motion which interacts wits the density gradient of the fluid caused by the localized heating of such fluid by the beam.

When such beam is focused down to a small spot size, for example 3–10 microns, the spinning particles are observed to spiral into the focal plane and become trapped by such spin-gradient force operating in both transverse directions and longitudinally. The present invention utilizes such spin-gradient interacting force to trap, separate, manipulate, and control particles and molecules of biological origin. Secondary effects of such interaction may also be exploited. An example of such secondary effect is the separation of such particles according to their sizes and densities as they become trapped or repelled commensurate with the strength of an applied vacuum and strength of an applied energy source.

There is no prior art, aside from U.S. Pat. No. 5,170,890 issued Dec. 15, 1992 to the present inventors, known to applicant in which such anomalous interaction (force) between the gradient of a field density and a particle spin or dipole moment induced by a beam of light is utilized to guide, trap, concentrate, separate, or control the motion of particles.

SUMMARY OF THE INVENTION

The present invention encompasses a method for applying and exploiting an anomalous interaction force between the gradient of a field density and a particle spin induced by a beam of light to trap, separate, manipulate, or control particles or molecules of biological origin. The light source may be coherent or noncoherent. Alternatively, other sources of energy may be used to induce such particle spin or dipole moment.

The present method utilizes light beams focused on particles and molecules of biological origin such as cells, cellular organelles, membranes, bacteria, viruses, and molecules such as chromosomes, DNA, RNA, and enzymes, so as to cause such particles and molecules to be attracted to such beam, against the direction of the propagating vector of the light; if the light source is from an incandescent light the particles spiral towards the focal plane; if the light source is a laser beam the particles stream back and forth. In both cases, particles become trapped in the focal plane and particles on the outer edge oscillate both toward and away from the focal plane while being repelled back by the particles near it.

One embodiment of the invention comprises a light source, a focusing lens, a partially evacuated chamber, and means to inject particles or molecules of biological origin into the chamber. When such particles are injected into said chamber the particles initially form an electrostatically charged clusters or groups. The heating effect of the light beam causes the particles at the edge of the beam to be heated on one side more than on the other side resulting in a rapid spinning motion imparted to the particle. The overall effect is a force which tends to repel the particles from regions of higher fluid density ( i.e. lower temperature) in both transverse directions and along the beam axis( longitudinal direction). Balancing repulsive forces therein causes the particles to orbit into the focus of the beam, where they are trapped. Furthermore, because such spinning particles induce stable vortex rings near the focal plane of the beam, such particles will tend to clump into separated series of spinning particle groups or clusters.

Another embodiment comprises such methodology applied in an apparatus where the light source is an intense collimated Gaussian beam focused on particles given an initial spin and orbital velocity and projected into said beam by an injector. In this embodiment the transverse spin-gradient forte will guide and constrain such particles to spiral orbits along the beam. This embodiment is useful as a particle guide and injector.

In still another application of the present methodology, particles or molecules of biological origin are suspended in a fluid between two glass plates forming a Schlieren slide. In this application a longer wavelength trapping beam of light is utilized to trap a single cell or other particle in its focus. A second beam of light is then used to induce photochemical reactions within the cell.

Accordingly, we claim the following as the objects and advantages of the invention: to provide a method for applying the disclosed methodology to trap, separate, manipulate end control both the extraction and injection of particles or molecules into cells, cellular organelles, membranes, bacteria, viruses, and molecules of biological origin such as DNA, RNA, enzymes, and the like; to provide such a method useful for the separation and identification of macromolecules; to provide such a method and apparatus useful for the separation and injection of genetic material into cell nuclei; and to provide such a method and apparatus useful for the purification of organic molecules.

Further objects are to provide a method for trapping and controlling particles in a collimated beam for fusing cells, injecting molecules such as DNA and RNA into nuclei, cell organelles and cell membranes, dissection and manipulation of chromosomes including injection of specific segments of DNA into chromosomes; or the removal of specific DNA segments from a chromosome; laser controlled photochemical reactions within a cell or cell structure such as a cellular membrane, mitochondria, nucleus, or other organelle; microsurgery of tissues, cells, or cell organelles; and laser probes of cellular chemical reactions induced by visible, IR light, ELF, RF, microwave electromagnetic radiation, and the like.

Still further objects include trapping living particles such as cells, bacteria, and viruses, and the extraction of material from trapped cells, cellular organelles, chromosomes, bacteria, viruses, and the like, and to provide a method for the controlled mixing and fusion of heterogeneous particles or molecules of biological origin .

The trapping, manipulating, separating, and controlling particles and molecules of biological origin using such method is applicable in a wide variety biological, chemical, and biotechnological fields. For example:

1. In cell fusion technology it would be very advantageous to be able to control the position and movement of microbial, plant or animal cells so as to facilitate a higher fusion rate.
2. The controlled separation of particles and molecules of biological origin such as DNA and RNA would be very useful for purification of such molecules and their manipulation.
3. Various impurities could be induced or disintegrated within a sample by controlling the frequency and power of the light beam, for example, a laser, thereby inducing magnetic fields or electric fields and controlling the spin of the particle.
4. Such method could be used in the form of a microsurgical device for tissues, cells, cellular organelles, membranes, and the like.
5. Other applications of such method include the extraction or injection of macromolecules such as DNA, RNA, chromosomes, enzymes, or the like, into or out of cells, organelles, membranes, or other macromolecule.

Further objects and advantages of the invention will be apparent from a consideration of the ensuing description and accompanying drawings.

DETAILED DESCRIPTION OF THE PREFERRED EMBODIMENT OF THE INVENTION

Figure 1B:
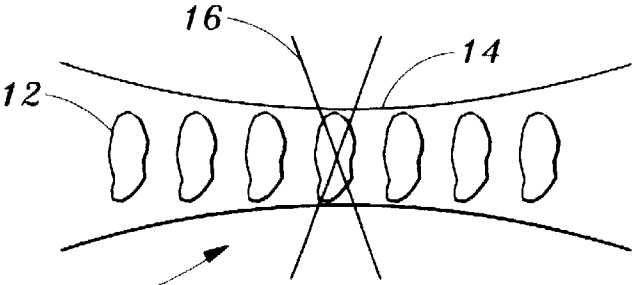
FIG. 1*b* shows a second auxiliary light beam used to extract particles of specific sizes, densities, and internal composition, according to the invention.

The present invention encompasses a method to trap, manipulate, separate, and control cellular components utilizing a particle trap to exploit an anomalous interaction (force) between the gradient of a field density and a particle spin induced by a beam of light. Such interaction can dominate the visual light pressure and cause variously sized particles and molecules to be attracted to a beam focus, against the direction of the propagating vector of the light.

The preferred embodiment of the invention comprises method for trapping, separating, manipulating and controlling particles and molecules of biological origin by a light induced particle trap, comprising: positioning said particles in a vacuum; projecting a first beam of light onto the particles; causing the first beam of light to impart a spinning motion to the particles; utilizing the first beam of light to impart a dipole moment to the particles; generating a field density gradient in the vacuum; trapping the particles in the first beam of light; concentrating the particles at a focal plane of the first beam of light; and manipulating the particles by a second auxiliary beam of light.

The vacuum may be a partial or a full vacuum. The beam of light may be coherent or noncoherent, or the spinning motion of the particles or molecules may be induced by a circularly polarized beam of light. The field density gradient is preferably a mass density gradient caused by local heating of the particles or molecules by a beam of light. To induce spinning motion of the particles or molecules, the particles or molecules are preferentially induced to spin by differential heating of the particles by a beam of light.

Alternatively, the field density gradient may be the electric field vector strength of a light beam in the partial or full vacuum. Trapping and guiding of the particles or molecules may be accomplished by controlling an interaction between a spinning particle and a mass density gradient effectuated by a local heating by the beam of light in a transverse direction. In another embodiment trapping and guiding particles in a beam of light is accomplished by interacting particles having a dipole moment induced by a beam of light and an electric field density gradient of the beam of light operating in a substantially transverse direction.

Concentrating particles is preferably induced at a focal plane of the beam of light and is accomplished by an interaction between the spinning particle and a mass density gradient actuated by a focused local heating of said beam of light in an essentially longitudinal direction. In another embodiment the particles are concentrated at a focal plane of the beam of light by an interaction between an induced dipole moment of said particles and an electric field density gradient of a focused beam of light in a generally longitudinal direction.

The separation of particles is preferably effectuated by controlling a balance between an electrostatic repulsion between the particles and a magnetic attraction between a magnetic field and a vortex field generated in the medium by charged, spiraling particles therein. Alternatively, in another embodiment of the invention the separation of particles is accomplished by inducing a dipole moment and a magnetic moment in the particles with a circularly polarized beam of light and controlling a balance between a repulsion of like ionized particles therein and the magnetic attraction between the particles magnetic moments so as to effect a separation of said particles thereby.

The utilization of the anomalous interaction force between the gradient of a field density and a particle spin or dipole moment induced by a beam of light is possible in various regimes, i.e. cell sized particles in fluids, micron-sized particles in air or fluid, angstrom-sized particles in a vacuum, etc. It is a principal utility of this invention to provide control of the motion of particles and molecules of biological origin in all these regimes and at the interface of these regimes. For example, for micron-sized particles using a partially evacuated chamber, a laser is preferably used to induce a rapid spinning motion of a particle or a plurality of particles. In such high Reynolds' number fluid regime, such particle or particles induce a turbulent vortex motion which interacts with the density gradient of the fluid caused by the localized heating of the fluid by the beam. The particle, such as a cell or cellular organelle, for example, is thus trapped in the beam spin-gradient force, i.e. the interaction between the spinning particle and the density field gradient of the fluid. The exploitation of this spin-gradient force by the method and apparatus provided herein enables the user to trap, guide, separate, concentrate, and control particles in novel and heretofore unattainable manner.

At atomic dimensions, such spin-gradient force may also be utilized. Here the particles or molecules are subject to a vacuum in a circularly polarized beam. Such beam induces a dipole moment in the outer electron shell of the atomic particle which interacts with the gradient of the electric field vector of the polarized beam. This results in a pondere motive force which attracts the particles to the center and focal plane of the polarized beam, thereby trapping them. Furthermore, the circularly polarized beam induces a magnetic moment similar to those observed in a paramagnetic spin system.

Such spin-gradient force may be utilized for trapping, concentrating, separating, manipulating, and controlling macro-sized particles, micron-sized particles, and sub-atomic sized particles using the present method including cells, cellular organelles, membranes, bacteria, viruses, and molecules such as DNA, RNA, enzymes, and the like.

Figure 1A:
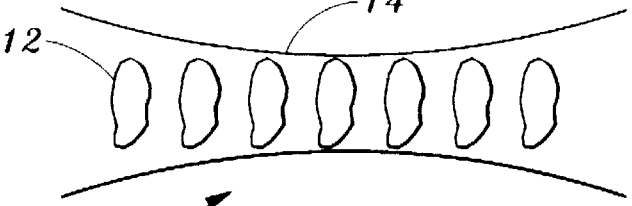
FIG. 1*a* is an illustration of particles (cells) or molecules of biological origin trapped near the focal place of a trapping beam of light, according to the method of the invention.

FIG. 1*a* shows the region near the focal plane 14 of a first trapping light beam 10 holding and positioning cells 12 therein. Preferably, trapping light beam 12 is utilized in a partial vacuum. If the light source is from an incandescent light cells 12 spiral towards the focal plane; whereas if the source is a laser beam the cells stream back and forth. In both cases, cells 12 become trapped in the focal plane 14 and cells on the outer edge of light beam 10 oscillate toward and away from the focal plane 14 being repelled back by the cells near it. The cell or cells near or at the focal plane 14 will remain in position as they rotate in the light's axis as well as rotate on their own axis. Particles entering near the focal plane 14 oscillate and become trapped, while those approaching are repelled. Cells, organelles, or molecules having different sizes and densities will be trapped in separate stable orbits, i.e., the focused light beam acts as a particle analyzer. For example, the classification of different cells from a matrix of biological material within a liquid medium, blood for instance.

Referring now to FIG. 1*b*, a second auxiliary beam of light 16, preferably of smaller wavelength and angular resolution as compared to the first beam of light 10, may be used to extract particles of specific size, densities, and internal composition (e.g. heat capacity) from the beam. For example, genetic material such as chromosomes, DNA, RNA, and the like can be trapped and analyzed, and specific genes or gene sequences isolated and manipulated.

Figure 2B:
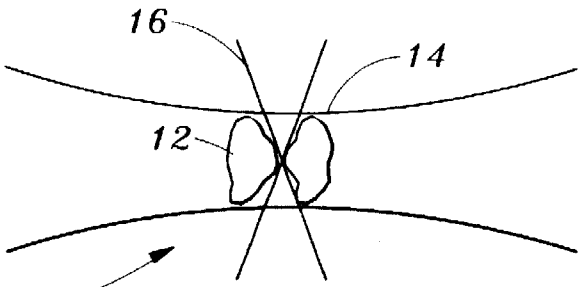
FIG. 2*b* shows a second auxiliary beam of light fusing cells trapped by a trapping beam of light, according to the invention.
Figure 2A:
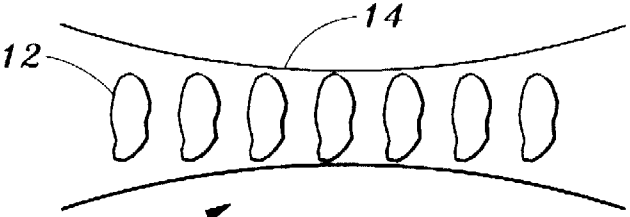
FIG. 2*a* shows a schematic view of a living cell introduced into a trapping beam of light, according to the invention.

In FIG. 2*a* illustrates the method when cells 12 is introduced into the first trapping beam of light 10 on either side of the focal plane 14. Such cells will spiral into focal plane 14, where they will be trapped. FIG. 2*b* shows how a second auxiliary beam of light 16, preferably of smaller wavelength and angular resolution may be used to rupture the cells membranes, and allow the cells to fuse together. For example, this method may be used to investigate bioenergy on the conformational states of cellular DNA in aqueous solutions.

When particles or molecules of biological origin are injected into the chamber, such particles or molecules initially form an electrostatically charged cluster or group. Due to the intense heating affect of the beam on the particles or molecules, the particles at the edge of the beam are heated on one side to a far greater extent than on the other side. This differential heating results in inducing the particle or molecule to rapidly spin.

Particles or molecules outside of the beam of light as well as particles or molecules completely inside of the beam of light are seen to drop out by the force of gravity in the chamber. Only particles on the edge of the light beam which are rapidly spinning are supported by the lift effect of the spin and are trapped within the beam. Such particles have a pitch angle, and because the air is much hotter inside the beam, a propeller effect results which forces the particle to orbit in a spiral motion towards the center, on either side of the focus, i.e. even against the direction of the beam of light.

The spinning particle induces a vortex motion in the surrounding fluid which causes the particle to be repelled by the cooler and denser air outside of the beam of light, and by the cooler and denser air further away from the focus. This is illustrative on one aspect of the aforementioned spin-gradient force, i.e. an interaction between the spinning particle and induced vortex, and the density gradient of the air caused by the local heating by the beam.

Figure 3B:
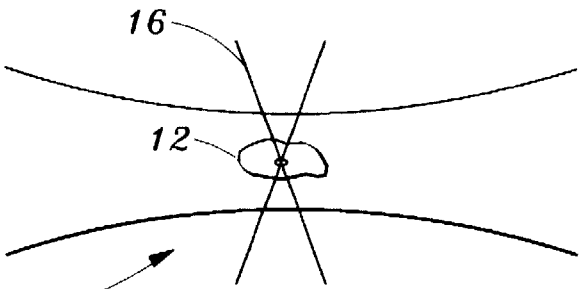
FIG. 3*b* shows a second auxiliary beam of light injecting specific material, such as chloroplasts, mitochondria, or the like into cells, according to the invention.
Figure 3A:
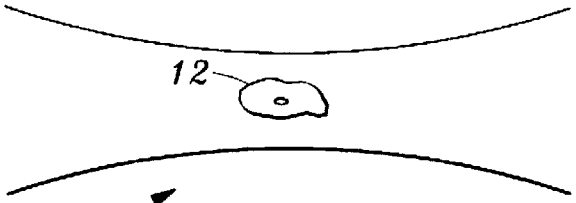
FIG. 3*a* shows a trapping beam of light tunes so that the size of the focal region is appropriate for trapping a single cell, according to the invention.

Referring now to FIG. 3*a*, the trapping beam of light 10 is, in this example, tuned so that the size of the focal region 14 is appropriate for the trapping of a single cell 12. In FIG. 3*b* a second auxiliary beam of light 16 is used to inject specific materials such as chloroplasts, mitochondria, or nuclei into cell 12. Preferably, this is achieved by simultaneously perforating the cell wall and transporting the materials by second auxiliary beam 16. By similar means, genetic material, such as chromosomes or chromosome segments may be extracted from cell 12, trapped, and manipulated, and then re-injected back into the cell. The trapping of a cell, organelle, or molecule by a beam is strongly dependent on the use of a light beam having a sharp boundary, such as a Gaussian laser beam, and applied in a partial vacuum. Such application causes a sharp temperature, and therefore a density gradient. The overall effect is a force which tends to repel the particle from regions of higher fluid density, that is lower temperature, in both transverse directions and along the beams axis in a longitudinal direction.

Balancing these repulsive forces in the transverse direction is the centripetal force caused by the orbiting particle or molecule of biological origin. The particle motion is constrained to orbit in a spiral around the edge of the beam by the balance between the spin gradient and the centripetal forces.

Such effect is also related to an important non-linear effect, namely to the negatively sloped coefficient of viscosity or negative resistance. For rapidly spinning particles i.e. those with a Reynolds number between approximately 10 and 100, a trajectory will be favored which makes the particle spin the fastest, for example, on the edge of the applied beam of light.

The resultant balance of such forces causes the particles or molecules, which may be cells, organelles, membranes, bacteria viruses, or molecules such as DNA and RNA to orbit into the focus of the beam, where they are trapped. As such the apparatus functions as a particle trap. Furthermore, because the spinning particles induce stable vortex rings near the focal plane of the beam, the, the clouds of particles will tend to clump into a separated series of spinning clusters or groups.

Figure 4:
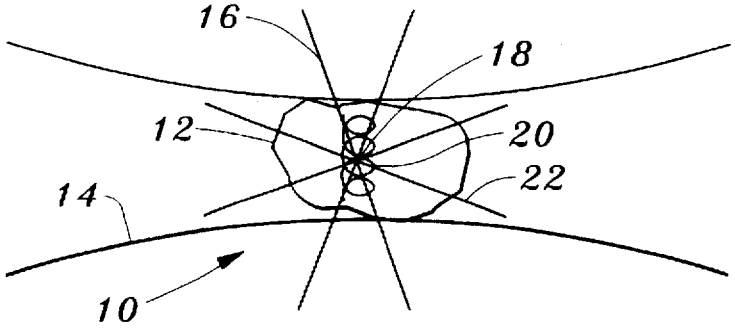
FIG. 4 shows a manipulation of a chromosome segment by injecting a gene sequence therein, according to the invention.

Referring now to FIG. 4, the present method is shown used to manipulate the gene sequence of a chromosome 18 in vivo within a cell 12. Cell trapping light beam 10, preferably with a long wavelength, traps cell 12. Then second auxiliary beam 16, preferably of an intermediate wavelength, traps and analyzes a single chromosome 20, so that the sequence of genes is directed along the optical axis of beam 16. A third probe light beam 22 is then applied to extract specific genes from chromosome 18, and to replace such genes with different genes as desired. This method thereby provides a completely optical method of gene splicing, which is highly efficient and cost effective.

In another embodiment an apparatus to exploit such spin-gradient force comprises a light source which is preferably an intense collimated Gaussian beam, so as to provide spin-gradient forces in a transverse direction, but not in a longitudinal direction. An injector provides an initial spin and orbital velocity to the cell, organelle, molecule or the like, and particles or molecules are injected into the collimated beam. The transverse spin-gradient force will guide and constrain the particles to spiral orbits along the beam. Therefore the prefer-ed application of such apparatus is as a particle guide and injector.

Figure 5:
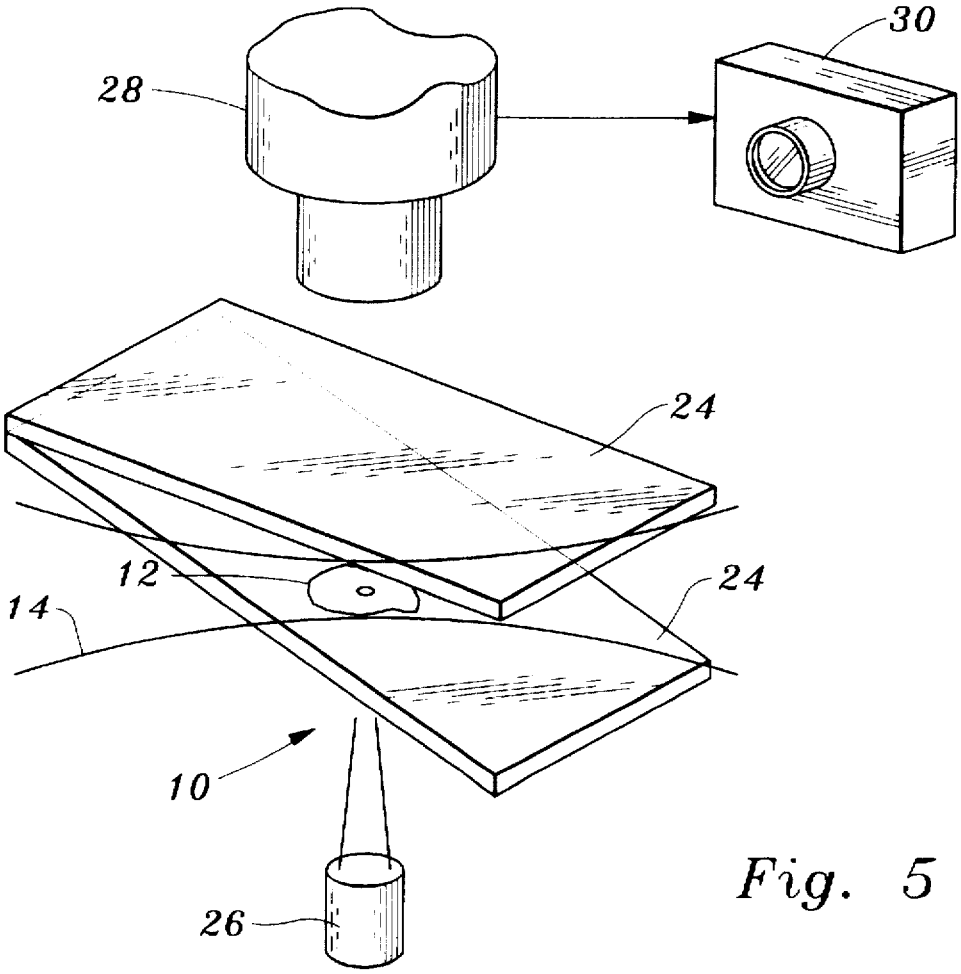
FIG. 5 shows an apparatus for suspending cells or molecules in a fluid between two glass plates forming a Schlieren slide with a trapping light beam controlling and positioning the cell or molecules and a second tuneable light beam utilized to induce photochemical reactions within the cell, according to the invention.

In FIG. 5, a preferred application of the present method is shown where cells 12, organelles, molecules or otter particles are suspended in a fluid between two glass plates 24 forming a Schlieren slide. First trapping light beam 10 is incident from the left and is able to trap a single cell 12 in its focus. Then a tuneable light source 26 in the visible spectral region (such as a dye laser) is incident from below, as shown, passing through cell 12 trapped in beam 10 and held in plates 24, and is then detected by a phase-contrast microscope 28 and high-speed camera 30. For example, any electrochemical boundary changes would show up as distinct phase changes and thus be revealed in phase-contrast microscope 28. By tuning the light source to specific frequencies, photochemical reactions may be induced in cell 12, resulting in small changes in the index of refraction of a targeted cellular substructure, such as organelles. The combination of the Schlieren slide and phase-contrast microscope 28 allow, for detection of such small phase changes of the visible light source caused by photochemical reactions in the cell which may be recorded in real time by means of high speed camera 30. For example, this method may be used for the unwinding or winding of a DNA strand and/or to observe any changes in any of the four bases which make up the strands of the DNA helix by noting changes in its index of refraction. Such method may by applied using laser-induced photochemical reactions on the order of picoseconds and could be used to study or manipulate biochemical reactions within a cell or organelle. Alternatively, such method may he used to record biochemical reactions induced by any means, e.g. extremely low frequency (ELF), RF, and microwave electromagnetic radiation.

The aforementioned spin-gradient force may also be utilized with cells, organelles, molecules, bacteria, viruses or other such particles or molecules of biological origin in a partial or in a complete vacuum. Preferably a circularly polarized light beam is used to induce a rotating dipole moment in the outer negatively charged electron shells of the particles or molecules which interact directly with the rotating electric field gradient of the beam of light. The particles will orbit in a manner as described above and they will be attracted towards the point of maximum electric field energy, i.e., towards the center of the beam of light in the transverse direction and towards the focal point along the beam axis.

If a laser is used as a light source, and such laser is tuned far from any resonant absorption band of the particles or molecules, this rotating induced dipole-field gradient force will dominate over the photon pressure caused by resonant absorption. Such particles or molecules are attracted to the abovementioned spin-gradient force and such functions are then readily implemented. The spin-gradient force will balance the centripetal force of the orbiting particles and such particles may then be manipulated and guided while trapped in the beam, such as insertion of DNA into a chromosomal segment. A microscopic analog of such nonlinear negative resistance will be obtained in the ionized channel of the beam. Generally, multiple particle orbits at different distances from the optical axis will occur close to the edge of the applied beam.

While the above description contains many specificities they should not be construed as limitations on the scope of the invention, but merely as exemplifications of preferred embodiments thereof. Those skilled in the art will envision many other possible variations are within its scope. The interrelation and control of the various forces and effects described herein provide a means for trapping and guiding any material particle or molecule of biological origin by exploitation of the interaction between the spinning particles and a field gradient. The asymptotic stability of the system will be determined by the non-linear effects in a fluid or ionized channel, or within the variation of an induced dipole moment in the particles. Such method and apparatus as described herein provides a means to exploit the non-linear spin-gradient force to trap, separate, manipulate and control particles or a plurality of particles such as cells, organelles, membranes, or molecule having a side variety of sizes, weights, and physical properties. Moreover, particles trapped in a laser beam, for example, in a liquid, behave similarly as that in a gas, albeit with a slight diminution of motion. Accordingly, the scope of the invention should be determined by the appended claims and their legal equivalents, and not by the examples which have been given.

We claim:

1. A method for trapping, separating, manipulating and controlling particles and molecules of biological origin by a light induced particle trap, comprising:

positioning said particles in a vacuum;

projecting a first beam of light onto said particles;

causing said first beam of light to impart a spinning motion to said particles;

utilizing said first beam of light to impart a dipole moment to said particles;

generating a field density gradient in said vacuum;

trapping the particles in the first beam of light;

concentrating the particles at a focal plane of the first beam of light; and manipulating the particles by a second auxiliary beam of light.

2. The method of claim 1, wherein said particles are cells.

3. The method of claim 1, wherein said particles are contaminant particles.

4. The method of claim 1, wherein said particles are first trapped and separated by said first beam of light and components of said particles are extracted by said second auxiliary beam of light.

5. The method of claim 4, wherein said particles are a chromosomal segment, said chromosomal segment being stabilized and separated by said first beam of light and components of said chromosomal segment being extracted by said second auxiliary beam of light.

6. The method of claim 4, wherein said particles are cellular organelles.

7. The method of claim 4, wherein said particles are cytoplasmic particles.

8. The method of claim 4, wherein said particles are bacteria.

9. The method of claim 4, wherein said particles are viruses.

10. The method of claim 1, wherein said particles are trapped by said first beam of light and matter injected into said particles by said second auxiliary beam of light.

11. The method of claim 10, wherein said particles are chromosomes and a chromosomal segment is injected into said chromosome by said second auxiliary beam of light.

12. The method of claim 10, wherein said particles are cells.

13. The method of claim 10, wherein said particles are cellular organelles.

14. The method of claim 10, wherein said particles are trapped by said first beam of light and analyzed by said second auxiliary beam of light, and then manipulated by a third beam of light.

15. The method of claim 14, wherein a particle trapped by said first beam of light is a single cell; a substructure of said single cell such as cellular organelle or chromosome is trapped and stabilized by said second auxiliary beam of light, and said third beam of light extracts or injects segments of said single cell or chromosome into a recipient structure.

16. The method of claim 1, wherein said particles are positioned within a Schlieren apparatus and trapped by said first beam of light and probed by said second auxiliary beam of light incident on said particle.

17. The method of claim 16, wherein said particles are probed by a tuneable light source capable of inducing a photochemical reaction within the particles.

18. The method of claim 16, wherein said trapped particles are irradiated with electromagnetic radiation.

19. The method of claim 16, wherein a chemical reaction within said particles induces a change of index of refraction of the particles so that a probe beam of light incident on the particles undergoes a phase change.

* * * * *